US011421568B2

(12) United States Patent
Madi et al.

(10) Patent No.: US 11,421,568 B2
(45) Date of Patent: Aug. 23, 2022

(54) MUFFLER WITH INTERNALLY SUPPORTED TUNER

(71) Applicant: Tenneco Automotive Operating Company Inc., Lake Forest, IL (US)

(72) Inventors: Abdulhadi Madi, East Lansing, MI (US); Isidro L. Hernandez, Ypsilanti, MI (US); Prajwal H. Rao, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 406 days.

(21) Appl. No.: 16/733,546

(22) Filed: Jan. 3, 2020

(65) Prior Publication Data

US 2021/0207507 A1 Jul. 8, 2021

(51) Int. Cl.
*F01N 1/02* (2006.01)
*G10K 11/162* (2006.01)

(52) U.S. Cl.
CPC ..... *F01N 1/023* (2013.01); *G10K 11/162* (2013.01); *F01N 2310/00* (2013.01); *F01N 2470/02* (2013.01); *F01N 2490/04* (2013.01); *F01N 2490/15* (2013.01)

(58) Field of Classification Search
CPC ..... F01N 1/006; F01N 1/023; F01N 1/026; F01N 13/1838; F01N 13/1844; F01N 13/185; F01N 2470/18; F01N 2490/04; F01N 2490/02; G10K 11/162
See application file for complete search history.

(56) References Cited

U.S. PATENT DOCUMENTS

| | | | | | |
|---|---|---|---|---|---|
| 1,655,230 | A * | 1/1928 | Kull | F01N 1/084 181/269 |
| 2,046,193 | A * | 6/1936 | Spicer | F01N 1/24 181/252 |
| 2,824,619 | A * | 2/1958 | De La Wilmore | F01N 3/005 181/252 |
| 2,834,425 | A | 5/1958 | Rawson | |
| 3,390,738 | A | 7/1968 | Kirsch | |
| 2016/0245138 | A1* | 8/2016 | Kinoshita | F01N 1/02 |
| 2017/0067379 | A1 | 3/2017 | Delorme et al. | |
| 2017/0335741 | A1* | 11/2017 | Krüger | F01N 1/026 |
| 2019/0178124 | A1* | 6/2019 | Ostromecki | F01N 1/085 |

FOREIGN PATENT DOCUMENTS

| | | | | |
|---|---|---|---|---|
| DE | 102009023029 | A1 | 12/2010 | |
| EP | 395540 | A * | 10/1990 | F01N 1/006 |
| EP | 2735715 | B1 | 8/2015 | |
| GB | 2243404 | A * | 10/1991 | F01N 1/006 |
| GB | 2260276 | B | 6/1995 | |
| JP | 2719933 | B2 | 2/1998 | |

* cited by examiner

*Primary Examiner* — Jeremy A Luks
(74) *Attorney, Agent, or Firm* — Harness, Dickey & Pierce, P.L.C.

(57) ABSTRACT

A muffler for receiving exhaust gas from a combustion engine is disclosed. The muffler includes a casing and a pipe. The casing includes a shell coupled to first and second end caps that cooperate to define an internal volume. The pipe is disposed within the internal volume and extends substantially a length of the shell. Each of the first and second end caps includes a circumferentially extending flange engaging an outer surface of the pipe to provide support for the pipe. Each circumferentially extending flange extends at an acute angle relative to a shell axis of the shell. Each circumferentially extending flange is coaxial along a pipe axis of the pipe.

10 Claims, 5 Drawing Sheets

MUFFLER WITH INTERNALLY SUPPORTED TUNER

FIELD

The present disclosure relates to a muffler with an internally supported tuner.

BACKGROUND

This section provides background information related to the present disclosure and is not necessarily prior art.

The flow of exhaust gas from an engine through one or more exhaust pipes can generate a substantial amount of noise. Mufflers have been used with exhaust systems to reduce this noise and/or tune the exhaust system so that exhaust gas flow therethrough generates a desired range of sounds. Tradeoffs between packaging space, performance, and sound characteristics are often made in the design of a muffler.

In one known example, a pipe extends through a muffler housing. The ends of the pipe disposed within the muffler housing are bent to position the inlet and outlet at desired locations. To properly bend the pipe without undesired deformation, certain portions of the pipe have to be free of perforations to allow gripping and bending of the pipe. The length of pipe along which the perforations may be positioned prior to the bending operation is reduced. Zones without perforations may be gripped with a tool to bend the pipe. Tuning opportunities may be limited based on the extent of pipe length that may be perforated. A need exists for a muffler that not only fits within a limited space on a vehicle but also exhibits a desired level of performance and tunability.

SUMMARY

This section provides a general summary of the disclosure, and is not a comprehensive disclosure of its full scope or all of its features.

In one form, the present disclosure provides a muffler for receiving exhaust gas from a combustion engine. The muffler includes a casing and a pipe. The casing includes a shell coupled to first and second end caps that cooperate to define an internal volume. The pipe is disposed within the internal volume and extends substantially a length of the shell. Each of the first and second end caps includes a circumferentially extending flange engaging an outer surface of the pipe to provide support for the pipe. Each circumferentially extending flange extends at an acute angle relative to a shell axis of the shell. The circumferentially extending flanges are coaxial along a pipe axis of the pipe.

In some configurations of the muffler of the above paragraph, the muffler includes a baffle disposed within the shell and cooperating with the shell to define first and second chambers. A first section of the pipe extends through the first chamber and includes apertures formed in substantially an entire length of the first section.

In some configurations of the muffler of any one or more of the above paragraphs, a tuner pipe extends from a second section of the pipe that extends through the second chamber. The tuner pipe is in fluid communication with the second chamber and the pipe.

In some configurations of the muffler of any one or more of the above paragraphs, the pipe has first and second ends. The first end is at or near one end of the first end cap and the second end is at or near another end of the second end cap that is opposite the one end of the first end cap.

In some configurations of the muffler of any one or more of the above paragraphs, an entire length of the pipe is straight.

In some configurations of the muffler of any one or more of the above paragraphs, each of the first and second end caps are formed from a single piece of stamped material.

In some configurations of the muffler of any one or more of the above paragraphs, the muffler includes a baffle disposed within the shell and including a circumferentially extending flange engaging the outer surface of the pipe. The circumferentially extending flange of the baffle is coaxial with the circumferentially extending flanges of the first and second end caps along the pipe axis.

In another form, the present disclosure provides a muffler for receiving exhaust gas from a combustion engine. The muffler includes a casing and a pipe. The casing includes a shell and first and second end caps that cooperate to define an internal volume. The first end cap defines a first opening and the second end cap defines a second opening. The pipe is disposed within the internal volume and has first and second ends. The first end extends at least partially through the first opening in the first end cap and the second end extends at least partially through the second opening in the second end cap. One of the first and second end caps includes a main body and first and second protrusions. The first protrusion protrudes from the main body toward the internal volume of the shell and includes a first surface, and the second protrusion protrudes from the main body away from the internal volume of the shell and includes a second surface. The first surface and the second surface extend along a common plane.

In some configurations of the muffler of the above paragraph, the plane extends at an angle relative to the main body.

In some configurations of the muffler of any one or more of the above paragraphs, the plane extends perpendicular to a longitudinal axis of the pipe.

In some configurations of the muffler of any one or more of the above paragraphs, the other of the first and second end caps includes another main body and third and fourth protrusions. The third protrusion protrudes from the another main body and includes a third surface and the fourth protrusion protrudes from the another main body and includes a fourth surface. The third surface and the fourth surface extend along another plane.

In some configurations of the muffler of any one or more of the above paragraphs, the other plane extends perpendicular to a longitudinal axis of the pipe.

In some configurations of the muffler of any one or more of the above paragraphs, the other plane extends parallel to the plane.

In some configurations of the muffler of any one or more of the above paragraphs, a flange extends from the first and second surfaces and forms the opening in the one of the first and second end caps. The pipe extends at least partially through the opening.

In some configurations of the muffler of any one or more of the above paragraphs, the first surface partially surrounds the flange and the second surface partially surrounds the flange.

In some configurations of the muffler of any one or more of the above paragraphs, a baffle is disposed within the shell and includes another main body and third and fourth protrusions. The third protrusion protrudes from the other main body and includes a third surface and the fourth protrusion protrudes from the other main body and includes a fourth surface. The third surface and the fourth surface extend along another plane.

In some configurations of the muffler of any one or more of the above paragraphs, the other plane extends perpendicular to a longitudinal axis of the pipe.

In some configurations of the muffler of any one or more of the above paragraphs, the other plane extends parallel to the plane.

In some configurations of the muffler of any one or more of the above paragraphs, the shell defines a longitudinal axis and the pipe defines a pipe axis that extends at an acute angle relative to the longitudinal axis.

In yet another form, the present disclosure provides a muffler for receiving exhaust gas from a combustion engine. The muffler includes a casing, a pipe and baffle. The casing includes a shell and first and second end caps that cooperate to define an internal volume. The pipe is disposed within the internal volume and defines a longitudinal axis. The pipe has a first end that extends toward the first end cap and a second end that extends toward the second end cap. The baffle is disposed within the shell and cooperates with the shell to define a plurality of chambers. The baffle includes a first main body and first and second protrusions. The first protrusion protrudes from the first main body toward the first end cap and includes a first surface and the second protrusion protrudes from the first main body toward the second end cap and includes a second surface. The first surface and the second surface extending along a common first plane. The first end cap includes a second main body and third and fourth protrusions. The third protrusion protrudes from the second main body toward the internal volume of the shell and includes a third surface, and the fourth protrusion protrudes from the second main body away from the internal volume of the shell and including a fourth surface. The third surface and the fourth surface extend along a common second plane. The second end cap includes a third main body and fifth and sixth protrusions. The fifth protrusion protrudes from the third main body toward the internal volume of the shell and includes a fifth surface, and the sixth protrusion protrudes from the third main body away from the internal volume of the shell and includes a sixth surface. The fifth surface and the sixth surface extending along a common third plane. The first, second and third planes are aligned with each other along the longitudinal axis of the pipe.

In some configurations of the muffler of the above paragraph, the first, second and third planes extend perpendicular to the longitudinal axis of the pipe.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
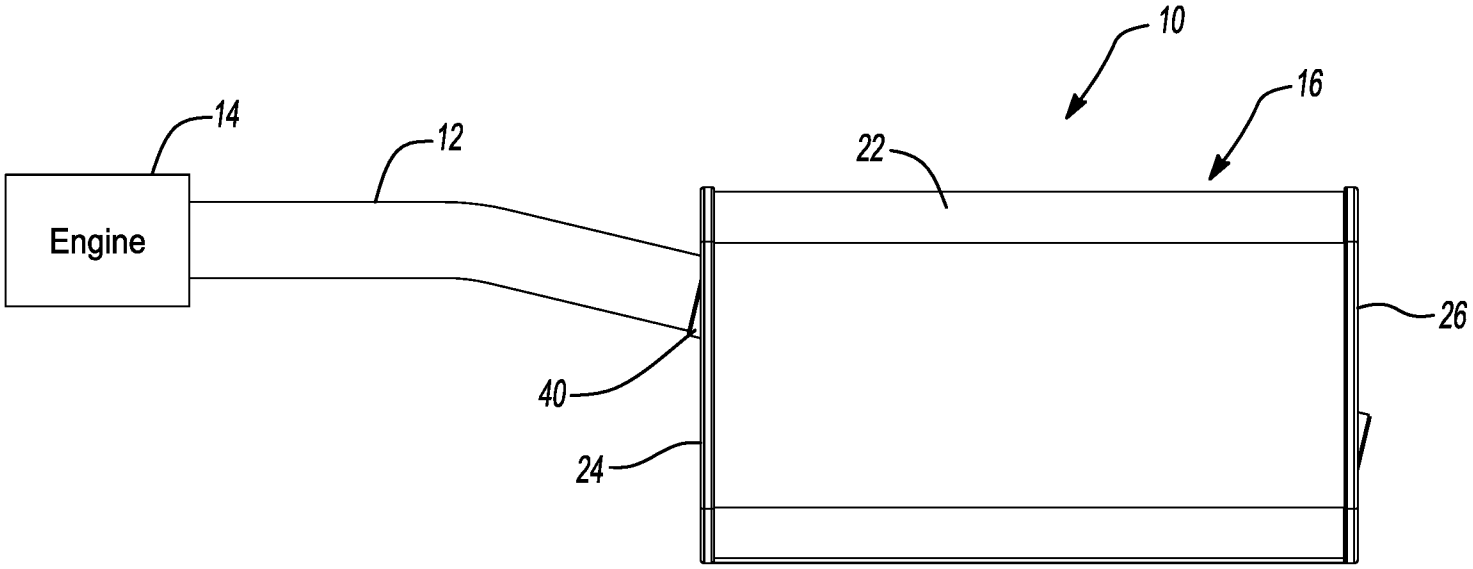
FIG. 1 is a schematic representation of an engine and exhaust system having a muffler according to the principles of the present disclosure.
Figure 2:
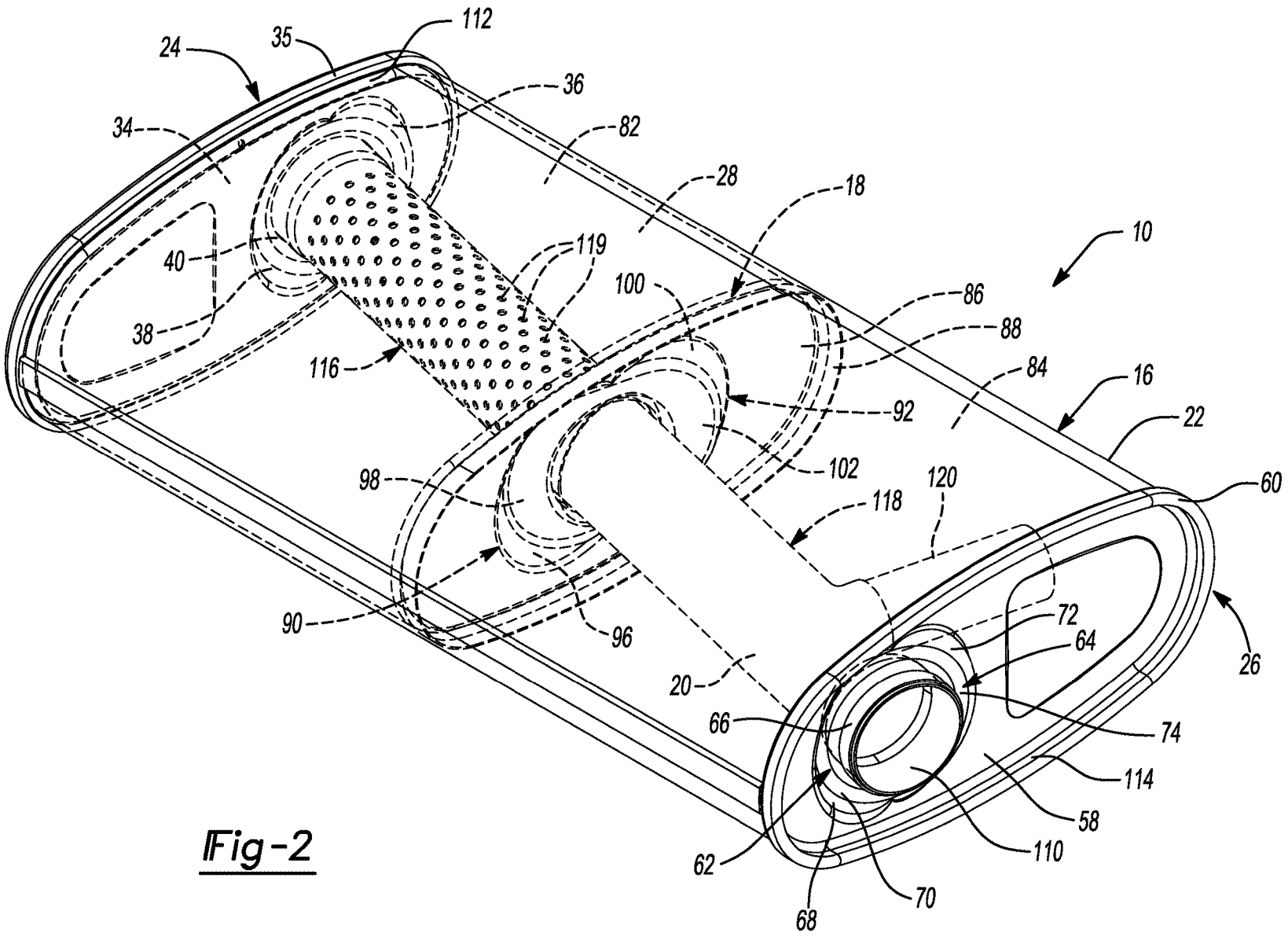
FIG. 2 is a perspective view of the muffler of FIG. 1.
Figure 3:
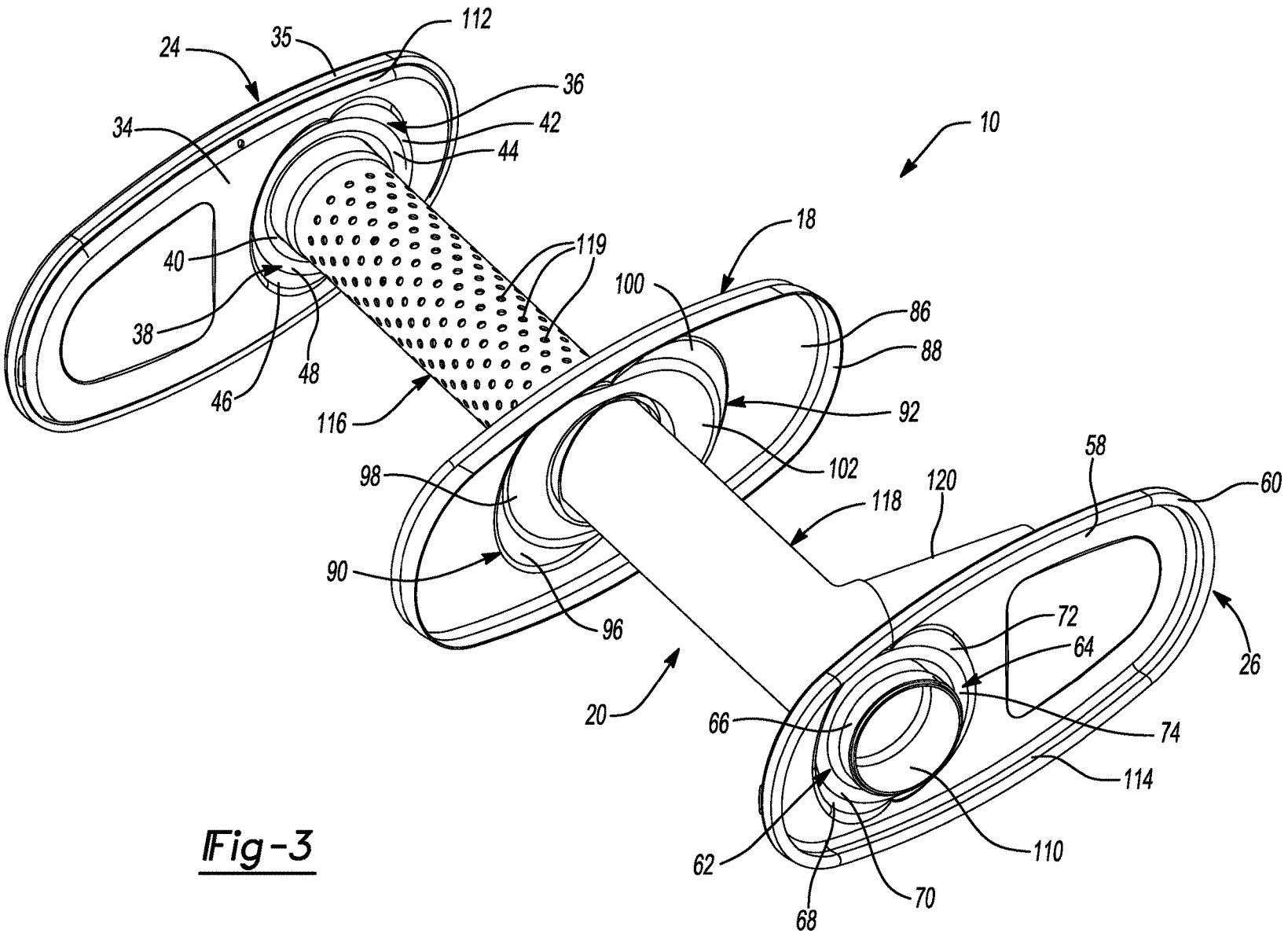
FIG. 3 is a perspective view of the muffler with a portion of an outer shell of the muffler removed.
Figure 4:
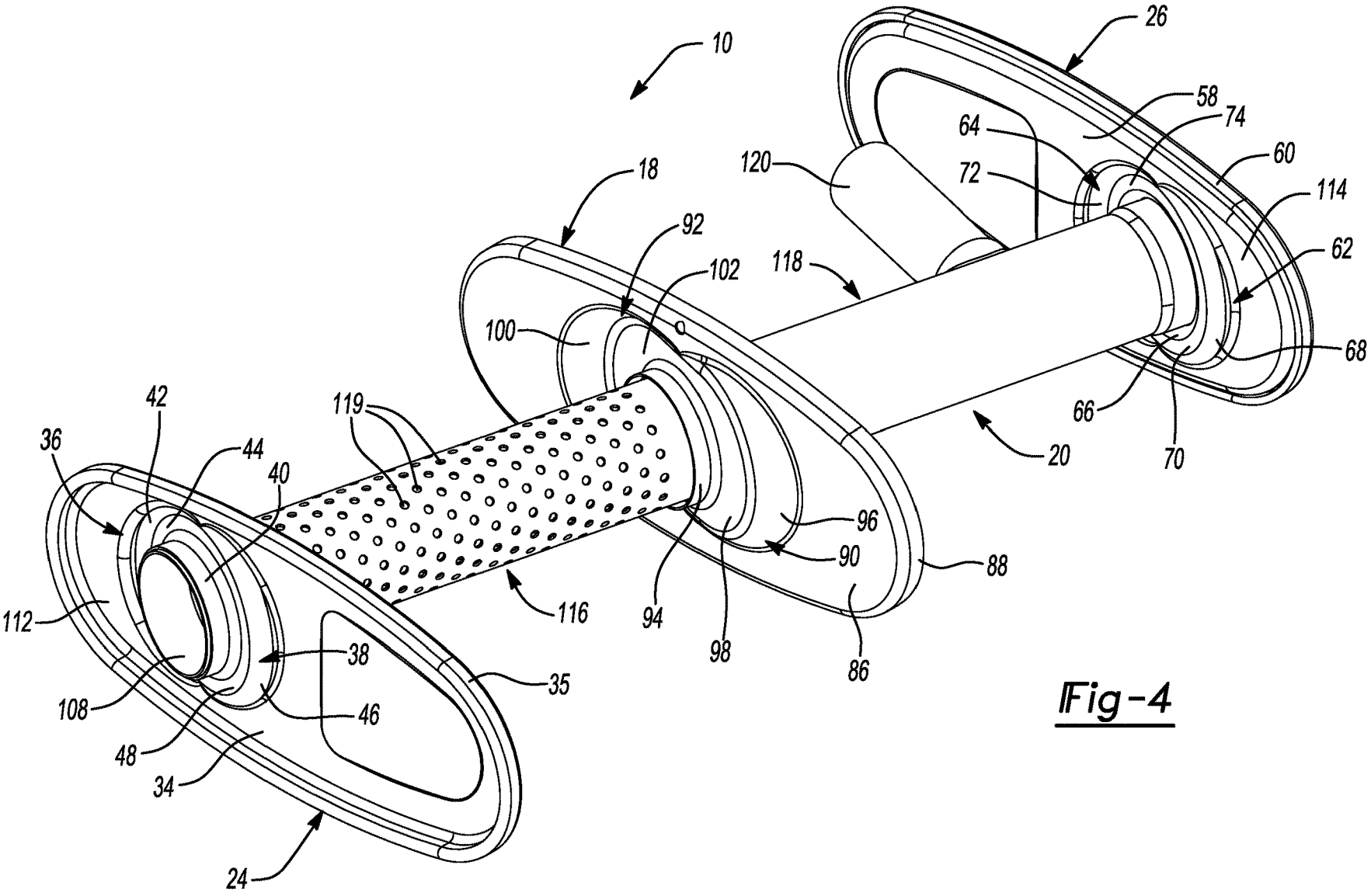
FIG. 4 is another perspective view of the muffler with a portion of an outer shell of the muffler removed.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIG. 1, a muffler 10 is provided that may receive exhaust gas from one or more exhaust pipes 12 connected to a combustion engine 14. The muffler 10 and exhaust pipe 12 are parts of an exhaust system that may include additional exhaust aftertreatment components (not shown). The muffler 10 may be shaped to fit within a given available space on a vehicle (not shown). For example, in some configurations, the muffler 10 may be shaped to fit between suspension components, a spare tire well or other components of the vehicle.

With reference to FIGS. 1-5, the muffler 10 may include a casing 16 (FIGS. 1, 2 and 5), an internal baffle 18 (FIGS. 2-5) and a pipe 20 (FIGS. 2-5). The casing 16 may include a shell 22, a first end cap 24 and a second end cap 26. The first and second end caps 24, 26 may be fixed to respective axial ends of the shell 22 and may cooperate with the shell 22 to define an internal volume 28. The first and second end caps 24, 26 may be welded, mechanically locked, or otherwise sealingly fixed onto the axial ends of the shell 22. In some configurations, the casing 16 could have a "clamshell" configuration whereby the casing 16 includes two shell halves (or two shell portions) that are welded, mechanically locked, or otherwise sealingly fixed together. In some of such configurations, one or both of caps 30, 32 could be attached to the shell halves (or portions) of the casing 16. Other multi-piece shell configurations are contemplated. For example, the muffler 10 could include an outer shell surrounding an inner shell.

As shown in FIGS. 2-5, the first end cap 24 may be manufactured from a single piece of stamped material, preferably metal, and may include a main body 34, a rim 35, a first protrusion 36, a second protrusion 38 and a flange 40. The rim 35 may extend around a periphery of the main body 34 and may be coupled to the respective axial end of the shell 22 such that the rim 35 is sealingly fixed to the shell 22. The first protrusion 36 may protrude from the main body 34 and into the internal volume 28. The first protrusion 36 protrudes toward the internal baffle 18 and the second end cap 26. The first protrusion 36 may partially surround the flange 40 and may include a first surface 42 and a second surface 44. The first surface 42 may be arcuate and may extend from the main body 34 to the second surface 44. The first surface 42 may also extend into the internal volume 28. The second surface 44 may be planar and may extend from an end of the first surface 42 to the flange 40.

Figure 5:
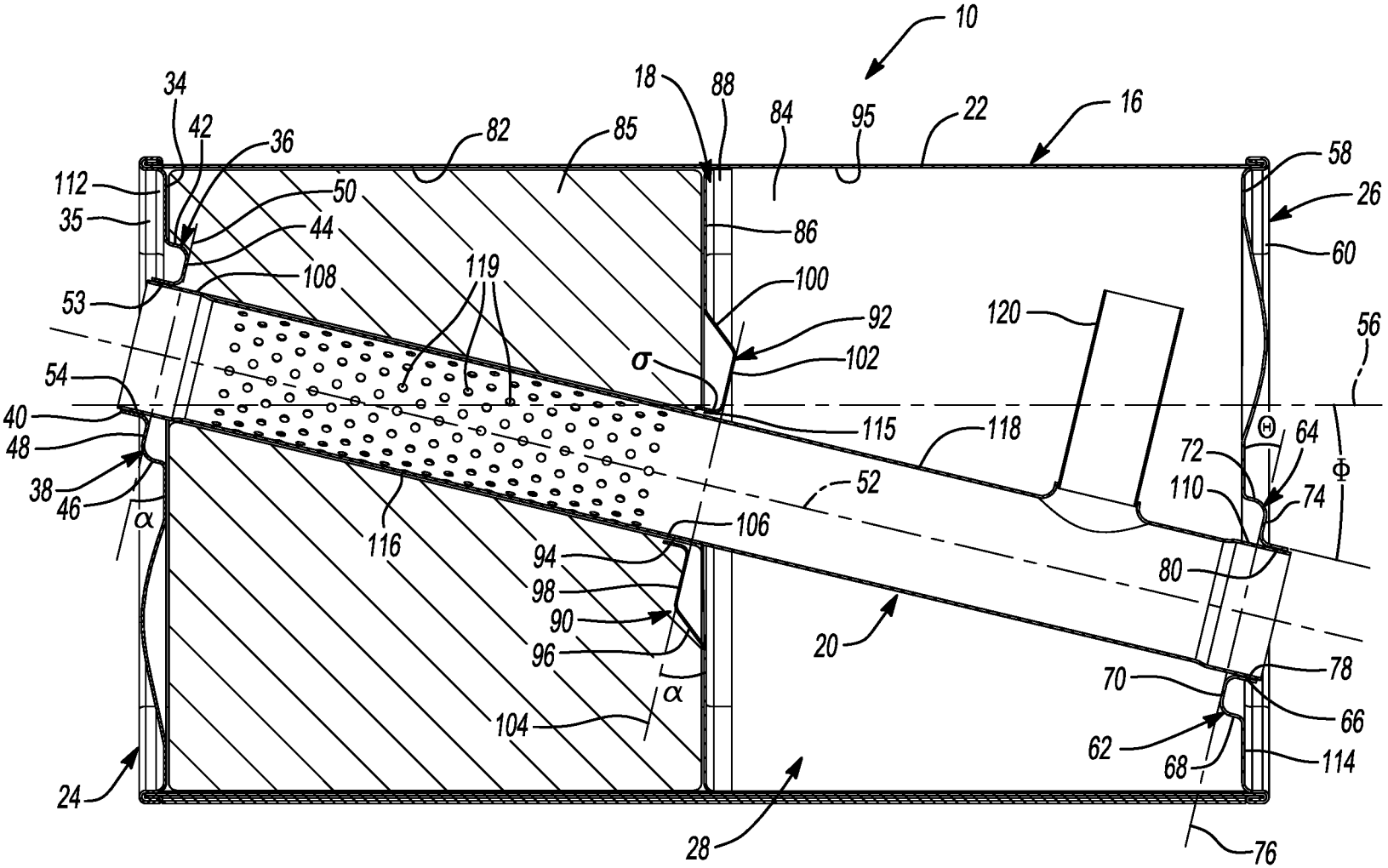
FIG. 5 is a cross-sectional view of the muffler of FIG. 1.

The second protrusion 38 may protrude from the main body 34 and away from the internal volume 28. The second protrusion 38 protrudes away from the internal baffle 18 and the second end cap 26. The second protrusion 38 may partially surround the flange 40 and may include a first surface 46 and a second surface 48. The first surface 46 may be arcuate and may extend from the main body 34 away from the internal volume 28. The second surface 48 may be planar and may extend from an end of the first surface 46 to the flange 40. As shown in FIG. 5, the second surface 44 of the first protrusion 36 and the second surface 48 of the second protrusion 38 may extend along a common plane 50 that is perpendicular to a longitudinal axis 52 of the pipe 20. The plane 50 also extends at an acute angle $\alpha$ relative to the main body 34 of the first end cap 24.

The circumferentially extending flange 40 extends from the second surface 44 of the first protrusion 36 and the second surface 48 of the second protrusion 38 and defines an opening 53 in the first end cap 24. The pipe 20 is received in the opening 53 and is sealingly engaged (e.g., welded) to an inner circumferential surface 54 of the flange 40 for support and for preventing fluid outside the pipe from entering into the internal volume 28. The flange 40 also extends at an acute angle $\beta$ relative to a longitudinal axis 56 of the shell 22 and extends parallel to axis 52 of the pipe 20.

As shown in FIGS. 2-5, the second end cap 26 may be manufactured from a single piece of stamped material and may include a main body 58, a rim 60, a first protrusion 62, a second protrusion 64 and a flange 66. The rim 60 may extend around a periphery of the main body 58 and may be coupled to the respective axial end of the shell 22 such that the rim 60 is sealingly fixed to the shell 22. The first protrusion 62 may protrude from the main body 58 and into the internal volume 28. The first protrusion 62 protrudes toward the internal baffle 18 and the first end cap 24. The first protrusion 62 may partially surround the flange 66 and may include a first surface 68 and a second surface 70. The first surface 68 may be arcuate and may extend from the main body 58 to the second surface 70. The first surface 68 may also extend into the internal volume 28. The second surface 70 may be planar and may extend from an end of the first surface 68 to the flange 66.

The second protrusion 64 may protrude from the main body 58 and away from the internal volume 28. The second protrusion 64 protrudes away from the internal baffle 18 and the first end cap 24. The second protrusion 64 may partially surround the flange 66 and may include a first surface 72 and a second surface 74. The first surface 72 may be arcuate and may extend from the main body 58 away from the internal volume 28. The second surface 74 may be planar and may extend from an end of the first surface 72 to the flange 66. As shown in FIG. 5, the second surface 70 of the first protrusion 62 and the second surface 74 of the second protrusion 64 may extend along a common plane 76 that is perpendicular to the longitudinal axis 52 of the pipe 20 and parallel to the plane 50. The plane 76 also extends at an acute angle $\theta$ relative to the main body 58 of the second end cap 26.

The circumferentially extending flange 66 extends from the second surface 70 of the first protrusion 62 and the second surface 74 of the second protrusion 64 and defines an opening 78 in the second end cap 26. The pipe 20 is received in the opening 78 and is sealingly engaged (e.g., welded) to an inner circumferential surface 80 of the flange 66 for support and for preventing fluid outside the pipe from entering into the internal volume 28. The flange 66 also extends at an acute angle $\phi$ relative to the longitudinal axis 56 of the shell 22 and extends parallel to the pipe 20 and the flange 40.

The internal baffle 18 may be disposed within the shell 22 and between the first and second end caps 24, 26. That is, as shown in FIG. 5, the internal baffle 18 may be disposed within the internal volume 28 and may divide the internal volume 28 into a first enclosed chamber 82 and a second enclosed chamber 84. The first chamber 82 may contain roving 85. The roving 85 may include fibrous material such as strands of fiberglass and/or other insulating materials that absorb sound (e.g., high-frequency sound) and dampen energy in the first chamber 82. The first chamber 82 may be defined by the internal baffle 18, the first end cap 24 and the shell 22. The second chamber 84 may be defined between the internal baffle 18, the second end cap 26 and the shell 22.

The internal baffle 18 may be manufactured from a single piece of stamped material and may include a main body 86, a rim 88, a first protrusion 90, a second protrusion 92 and a flange 94. The rim 88 may extend around a periphery of the main body 86 and may be coupled to the shell 22 such that the rim 88 is sealingly fixed to the shell 22. That is, the rim 88 of the internal baffle 18 may be shaped to generally match the contours of an inner circumferential wall 95 of the shell 22. The rim 88 may be welded, mechanically locked, or otherwise sealingly fixed to the inner circumferential wall 95.

The first protrusion 90 may protrude from the main body 86 and into the first chamber 82. The first protrusion 90 protrudes toward the first end cap 24. The first protrusion 90 may partially surround the flange 94 and may include a first surface 96 and a second surface 98. The first surface 96 may be arcuate and may extend from the main body 86 to the second surface 98. The first surface 96 may also extend into the first chamber 82. The second surface 98 may be planar and may extend from an end of the first surface 96 to the flange 94.

The second protrusion 92 may protrude from the main body 86 and into the second chamber 84. The second protrusion 92 protrudes toward the second end cap 26. The main bodies 34, 58, 86 of the end caps 24, 26 and the internal baffle 18, respectively, extend parallel to each other. The second protrusion 92 may partially surround the flange 94 and may include a first surface 100 and a second surface 102. The first surface 100 may be arcuate and may extend from the main body 34 into the second chamber 84. The second surface 102 may be planar and may extend from an end of the first surface 100 to the flange 94. As shown in FIG. 5, the second surface 98 of the first protrusion 90 and the second surface 102 of the second protrusion 92 may extend along a common plane 104 that is perpendicular to the longitudinal axis 52 of the pipe 20 and parallel to planes 50, 76. The plane 104 also extends at an acute angle $\gamma$ relative to the main body 86 of the internal baffle 18.

The circumferentially extending flange 94 extends from the second surface 98 of the first protrusion 90 and the second surface 102 of the second protrusion 92 and defines an opening 106 in the internal baffle 18. The pipe 20 is received in the opening 106 and is coupled (e.g., spot welded) to the flange 94 for support. A gap 115 may be between the flange 94 and an outer cylindrical surface of the pipe 20 along a majority of a periphery of the flange 94. The gap 115 is minimized in the present embodiment to prevent roving 85 in the first chamber 82 from flowing to the second chamber 84. A few locations of the flange 94 may be spot welded to the pipe 20 to connect the baffle 18 to the pipe 20. The flange 94 may be spot welded directly to the pipe 20 or may be spot welded to the pipe 20 via a tab (not shown). The flange 94 also extends at an acute angle $\sigma$ relative to the longitudinal axis 56 of the shell 22 and extends parallel to the pipe 20. The flanges 40, 66, 94 may be coaxial along the longitudinal axis 52 of the pipe 20.

The pipe 20 may be disposed within the internal volume 28 and may extend a length of the shell 22. The pipe 20 may also extend at least partially past the first and second ends caps 24, 26 such that portions of the pipe are external relative to the casing 16. The pipe 20 may have a first end 108 that extends at least partially through the opening 53 of flange 40 and a second end 110 that extends at least partially through the opening 78 of flange 66. The first end 108 may be near or at an end 112 of the first end cap 24 and the second end 110 may be near or at an end 114 of the second end cap 26 that is opposite the end 112 of the first end cap 24.

The pipe 20 may be a straight pipe (i.e., not including any bends along a length thereof) and includes a first section 116 and a second section 118. The first section 116 is disposed within the first chamber 82 and extends through the first chamber 82. The first section 116 includes apertures 119 formed along substantially an entire length of the first section 116. The second section 118 is disposed within the second chamber 84 and extends through the second chamber 84. A Helmholtz tuner 120 may extend radially into the second chamber 84 from the second section 118 of the pipe 20. The tuner 120 causes an internal cavity of the pipe 20 to be in fluid communication with the second chamber 84.

The muffler 10 of the present disclosure provides the benefit of allowing the pipe 20 to be disposed within the shell 22 and not include any bends therein which improves packaging of the muffler 10. Because the pipe 20 does not include bends that may require physical engagement by a bending tool, the entire length of first section 116 of the pipe 20 may include apertures 119. By providing apertures 119 within a greater extent of length of first chamber 82 than previously feasible, acoustic dampening may be enhanced.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A muffler for receiving exhaust gas from a combustion engine, the muffler comprising:

a casing including a shell and first and second end caps that cooperate to define an internal volume, the first end cap defining a first opening and the second end cap defining a second opening; and a pipe disposed within the internal volume and having first and second ends, the first end extending at least partially through the first opening in the first end cap and the second end extending at least partially through the second opening in the second end cap, wherein one of the first and second end caps includes a main body and first and second protrusions, the first protrusion protruding from the main body toward the internal volume of the shell and including a first surface, and the second protrusion protruding from the main body away from the internal volume of the shell and including a second surface, wherein the first surface and the second surface extend along a common plane, wherein the one of the first and second end caps includes a tubular flange extending from the first and second surfaces and forms the first or second opening in the one of the first and second end caps, and wherein the pipe extends at least partially through the first or second opening and is in engagement with an inner tubular surface of the tubular flange, the tubular flange extending perpendicular to the common plane, wherein the first surface partially surrounds the tubular flange and the second surface partially surrounds the tubular flange.

2. The muffler of claim 1, wherein the plane extends at a non-right angle relative to the main body.

3. The muffler of claim 1, wherein the plane extends perpendicular to a longitudinal axis of the pipe.

4. The muffler of claim 1, wherein the other of the first and second end caps includes another main body and third and fourth protrusions, and wherein the third protrusion protrudes from the another main body and includes a third surface and the fourth protrusion protrudes from the another main body and includes a fourth surface, the third surface and the fourth surface extend along another plane.

5. The muffler of claim 4, wherein the another plane extends perpendicular to a longitudinal axis of the pipe.

6. The muffler of claim 4, wherein the another plane extends parallel to the plane.

7. The muffler of claim 1, further comprising a baffle disposed within the shell and including another main body and third and fourth protrusions, the third protrusion protrudes from the another main body and includes a third surface and the fourth protrusion protrudes from the another main body and includes a fourth surface, the third surface and the fourth surface extend along another plane.

8. The muffler of claim 7, wherein the another plane extends perpendicular to a longitudinal axis of the pipe.

9. The muffler of claim 7, wherein the another plane extends parallel to the plane.

10. The muffler of claim 1, wherein the shell defines a longitudinal axis and the pipe defines a pipe axis that extends at an acute angle relative to the longitudinal axis.

* * * * *